US006073460A

United States Patent [19]

Credle, Jr. et al.

[11] Patent Number: 6,073,460

[45] Date of Patent: Jun. 13, 2000

[54] ROTARY COOLER

[75] Inventors: William S. Credle, Jr., Stone Mountain; Jason E. Allen, Powder Springs, both of Ga.

[73] Assignee: The Coca-Cola Company, Atlanta, Ga.

[21] Appl. No.: 09/110,847

[22] Filed: Jul. 7, 1998

[51] Int. Cl.[7] ..... A47F 3/04

[52] U.S. Cl. ..... 62/250; 62/337; 62/381

[58] Field of Search ..... 62/250, 337, 381

[56] References Cited

U.S. PATENT DOCUMENTS

| | | | |
|---|---|---|---|
| 1,857,545 | 5/1932 | Hill . | |
| 1,872,032 | 8/1932 | Frick et al. . | |
| 2,261,910 | 11/1941 | Wright . | |
| 2,610,473 | 9/1952 | Chovanec . | |
| 2,677,940 | 5/1954 | Raskin . | |
| 2,928,705 | 3/1960 | Goldsmith . | |
| 2,950,605 | 8/1960 | Hennion | 62/250 |
| 3,021,691 | 2/1962 | Jacobs . | |
| 3,063,255 | 11/1962 | Fanick, Jr. et al. . | |
| 3,769,805 | 11/1973 | Corini . | |
| 4,185,810 | 1/1980 | Eichenberger et al. | 62/381 |
| 4,261,183 | 4/1981 | Plomp | 62/63 |
| 4,299,099 | 11/1981 | Myers et al. . | |
| 5,097,673 | 3/1992 | Negishi . | |
| 5,125,240 | 6/1992 | Knippscheer et al. | 62/337 |
| 5,664,435 | 9/1997 | Bassuk | 62/381 |
| 5,689,967 | 11/1997 | Fløysvik . | |
| 5,797,279 | 8/1998 | Osborne | 62/381 |

*Primary Examiner*—Ronald Capossela
*Attorney, Agent, or Firm*—Finnegan, Henderson, Farabow, Garrett & Dunner, L.L.P.

[57] ABSTRACT

A cooler has a housing with a plurality of rotatable shelves. The shelves can move from an interior portion of the housing to an exposed exterior portion adjacent a discharge port of the cooler. The cooler is doorless so that access and viewing of the products in the port are unobstructed. An interior storage area is provided in the cooler for replenishment of removed products. An escapement mechanism can automatically load products from the storage area to empty slots on the periphery of the rotating shelf. Efficient cooling of the products is obtained. The shelves of the cooler can be rotated at the same or different speeds and/or directions. This merchandising cooler will not blend in with its surrounding environment to thereby attract a consumer's attention.

22 Claims, 4 Drawing Sheets

ROTARY COOLER

BACKGROUND OF THE INVENTION

1. Field of the Invention

The present invention relates to a doorless merchandising cooler with rotating shelves that move to present products to consumers.

2. Description of the Background Art

Various coolers are known in the art. In fact, current impulse merchandising coolers are so prevalent, that they have started to blend in with their surroundings.

Other problems with existing coolers are the use of hinged or sliding doors. Such doors can often make it hard to see the product if the glass door is scratched, dirty or masked with advertisements. Fogging or condensation on the glass can also make it difficult to see the product. Moreover, bulky door frames reduce the viewing area. Existing coolers with doors are best facilitated by the use of two hands, one to open the door and the other to grasp the product. This can often be inconvenient for the consumer. Also, insulated glass doors in existing coolers are expensive.

Another problem existing with conventional coolers is that most do not have a first-in-first-out loading system. This can result in warm products being presented to a consumer.

Accordingly, a need in the art exists for a doorless cooler which will stand out from conventional coolers and will have a first-in-first-out loading system.

SUMMARY OF THE INVENTION

Accordingly, it is an object of the present invention to provide a cooler with a moving display so as to attract a consumer's attention.

It is a further object of the present invention to provide a doorless cooler thereby requiring only one hand for a consumer to withdraw a product therefrom.

Another object of the present invention is to provide a cooler with a first-in-first-out loading system in order to ensure that the consumer is presented with a cooled product.

These and other objects of the present invention are fulfilled by a cooler comprising: a housing with a discharge port, the housing having an interior portion and an exposed portion, the exposed portion being adjacent the discharge port, the exposed portion of the housing being open to ambient environment through the port for unobstructed access to the exposed portion of the housing; a movable shelf; a drive for moving the shelf between the interior portion of the housing and the exposed portion of the housing; a refrigeration device for cooling at least the interior portion of the housing; a storage area within the interior portion of the housing; and an escapement mechanism for loading products on the shelf from the storage area.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
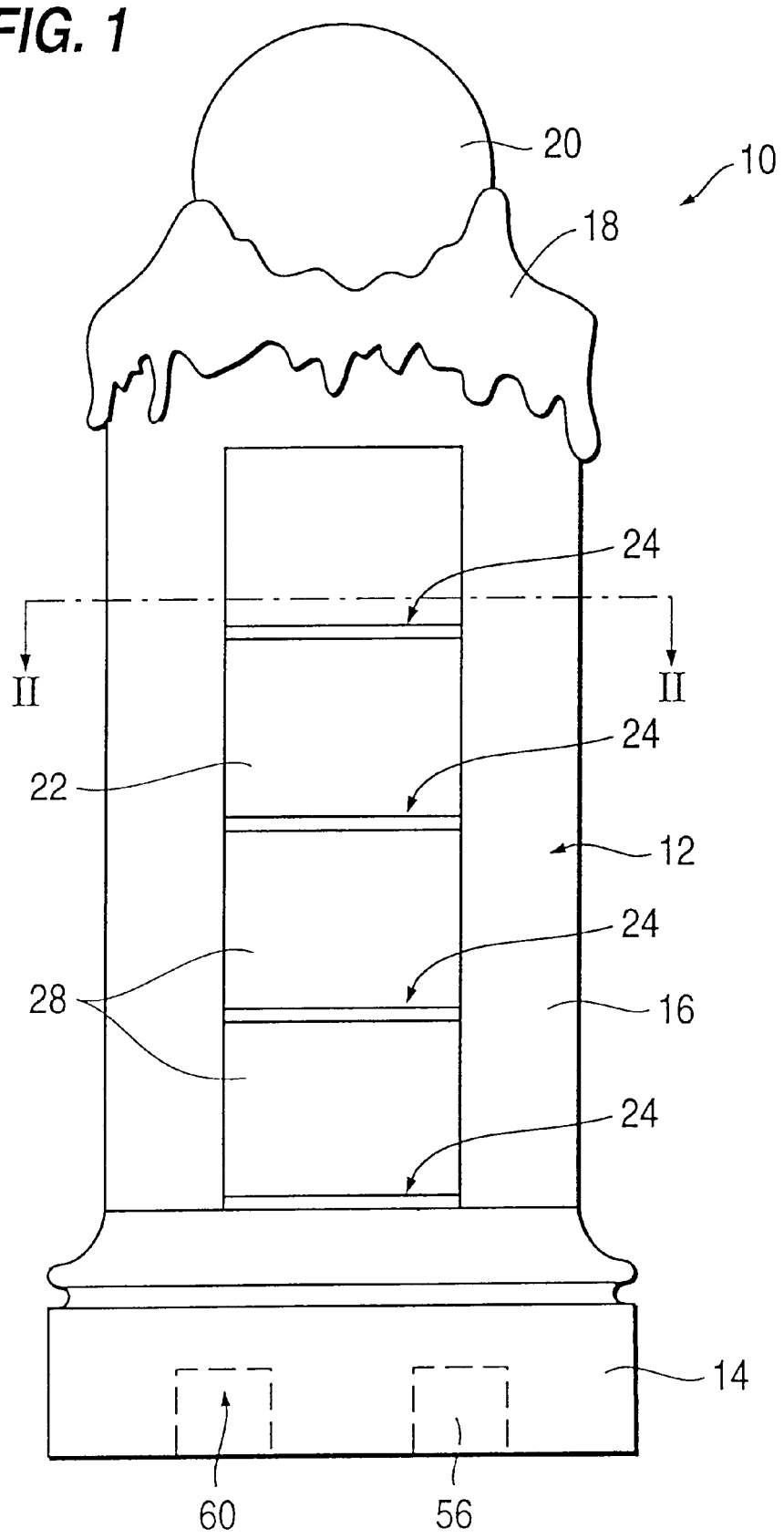
FIG. 1 is a front elevational view of the cooler of the present invention.

Referring in detail to the drawings and with particular reference to FIG. 1, a cooler 10 of the present invention is shown. This cooler 10 includes a housing 12 formed from a base 14, body 16 and a top 18. This top 18 can be molded or otherwise formed to look like ice. Embedded in the simulated ice is a sign 20. Product information can appear on the sign 20.

Figure 2:
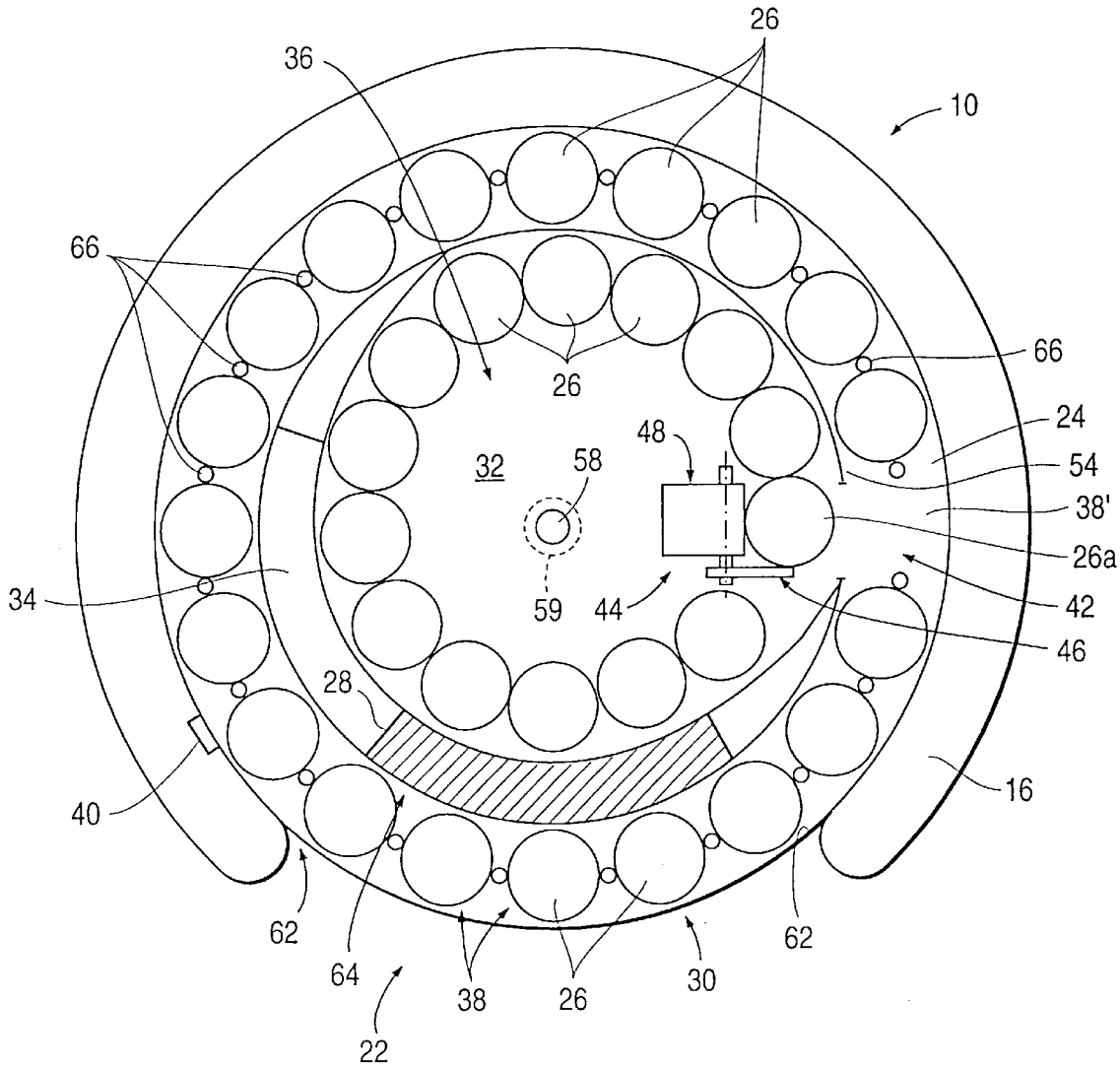
FIG. 2 is a cross sectional view taken along line II—II of FIG. 1.

In the front of the body 16 of housing 12, an open access port 22 is provided. Through this port 22, a plurality of rotating shelves 24 are accessible. This port 22 is also shown in FIG. 2. As will become apparent in FIG. 2, each of the shelves 24 have a round shape. A portion of the shelves 24 are accessible by a consumer through the port 22. Products 26 are provided on the shelves 24. Along the length of each port 22, a plurality of products 26 are readily accessible.

As will be explained in more detail below, each of the shelves 24 can be rotated in a number of different manners. As the shelves 24 rotate, they present a plurality of products 26 to a consumer. This moving display will attract the consumer's attention.

As seen in FIGS. 1 and 2, a thermally insulated panel 28 is provided at the rear of the port 22. Within the housing 12, the area defined between the panel 28 and the port 22 forms an exposed portion 30 of the housing 12. Within the confines of the housing 12 and in particular, in an area within at least the body 16 and inside of panel 28, the interior portion 32 of the housing 12 is provided. Therefore, the housing 12 can be considered as having an exposed portion 30 and an interior portion 32.

In the exposed portion 30, products 26 are presented on rotating shelves 24. The shelves 24 are rotated to present products 26 at a speed that is fast enough to attract a consumer's attention but not so fast as to make the consumer feel uneasy about grabbing the product 26.

While circular products 26 are shown, it is contemplated that any type of product can be displayed, vended or dispensed from the cooler 10 of the present invention. For example, beverage cans or beverage bottles, other food products or any other suitable items can be held by the cooler 10.

In FIG. 2, the shelf 24 is a one-piece construction with a generally round shape and is continuous throughout the exposed portion 30 and interior portion 32 of the housing 12. The shelf extends beneath panel 28. This panel 28 is thermally insulated and separates products stored in the interior of the housing from those in the exposed portion 30 as will be described in more detail below. This panel 28 is slidable between the closed position as shown in FIG. 2 to an open position in pocket 34. When this insulated panel 28 is moved into this pocket 34, products can be loaded into an interior storage area 36 through the port 22. When the panel 28 is in the closed position as shown in FIG. 2, then only those products 26 on the exposed portion 30 of the housing 12 will be visible to a consumer. Therefore, the present invention will present products 26 in a single-file fashion. If the products are presented in a fashion other than a single depth row, the product presentation can look disorderly and consumer's could knock over products when trying to reach into the cooler. The present invention therefore provides for a neat display which will tend to remain well organized. However, more than single depth presentations are contemplated herein. Furthermore, panel 28 need not be slidable, and product may be loaded by other techniques.

As mentioned above, within the interior of the housing 12 is storage area 36. This storage area 36 holds a plurality of products 26 as shown in FIG. 2. The products 26 will normally rest on and rotate with shelf 24. Therefore, the products 26 on the periphery of the shelf 24 and on interior portions of the shelf 24 tend to rotate with the shelf. This rotation will reduce friction and potential scuffing between the bottoms of the products 26 and the shelf 24. This helps to maintain a good looking product appearance. If it were so desired, however, the products 26 in the storage area 36 could be held in position as will be described in detail below. If scuffing of the bottom of the products is not a problem when the shelf rotates, then such an arrangement would be acceptable. For example, if the products are immune to scuff marks or are quickly sold from the cooler, then it would not be a problem to have the shelf rotating beneath products 26 held in position.

In the embodiment of FIG. 2, the products 26 in the storage area 36 continually rotate with shelf 24. Around the periphery of the shelf 24 are a plurality of product placement slots 38. As shown in FIG. 2, the product placement slots 38 are evenly spaced in order to present an orderly arrangement of products 26.

The product placement slots 38 are defined by a plurality of vertical pins or guides 66. These guides on the shelves 24 prevent the products 26 from tipping and make sure that the there are discrete pockets or placement slots 38 for receiving products. If so desired, a pegboard-type arrangement can be provided around the periphery of the shelf 24 so that the guides 66 can be readily moved in order to accommodate different sized products. However, it is contemplated that these guides 66 will normally be permanently mounted on the shelves 24. Furthermore, any type of guide, or no guide at all, can be used without departing from the present invention.

One of the slots 38' is empty in FIG. 2. When a consumer removes a product 26 from the port 22, then an empty slot 38' would result. A detector 40 is provided for determining when a product is absent from a product placement slot 38. While the detector 40 is shown as being in the body 16 of housing 12, this detector could be located in any suitable location. For example, the detector 40 could be located over or under the shelf 24 or adjacent the storage area 36. This detector 40 can be a photo-detector which uses light to sense the presence or absence of product 26. Alternatively, a mechanical finger or other sensor can be used which engages the product and will determine when a slot 38 is empty. Alternatively, sensors beneath each of the slots 38 can be provided such that when a product is lifted from the slot, absence of the product can be detected. Alternatively, openings can be provided in the shelf 24 beneath each of the product placement slots 38. When the openings pass over a detector located downstream from the port 22, then absence or presence of a product 26 can be detected. Many different types of detectors are suitable for use with the present cooler 10.

In FIG. 2, a single detector 40 is indicated. However, a detector 40 could be provided on the opposite side of the port 22 or a detector could be provided on each side of the port 22. Such an arrangement would accomodate rotation of the shelf in either a clockwise or counter clockwise direction. As will be discussed in more detail below, it is contemplated that the shelves can rotate in either direction. While it is desirable for the detector 40 to be downstream of the port 22 to thereby immediately detect removal of a product from slot 38, it is possible that a single detector 40 could be presented upstream of the port 22. In such a situation, an empty product placement slot 38 can be presented at the port 22 for at least one rotation of the shelf. However, it is more desirable to have the detector 40 placed downstream of the port 22 and upstream of any filling means such that products can immediately fill empty product placement slots 38 and such that the port 22 is continually presenting products in all slots 38.

Figure 3:
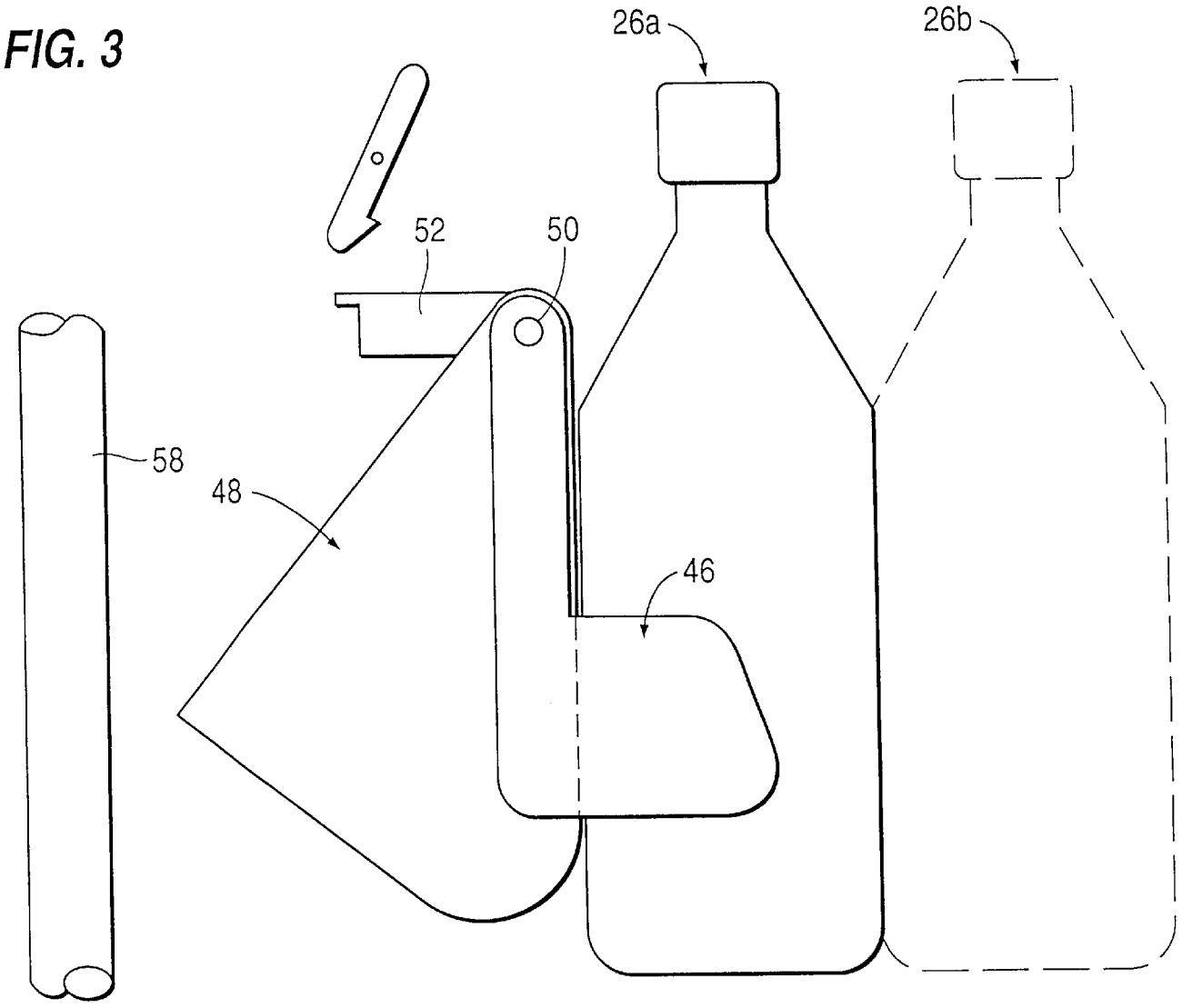
FIG. 3 is an elevational view showing the escapement mechanism of the cooler of the present invention.

Downstream of the detector 40 in FIG. 2 is a loading area 42. The empty slot 38' would be detected by the detector 40 and then an escapement mechanism 44 would be activated in order to move a single product 26*a* to the empty product placement slot 38. This escapement mechanism 44 includes a flag 46 and pusher 48 as shown in FIGS. 2 and 3. In FIG. 3, the flag 46 is shown in an activated position. This flag 46 is mounted on fixed support 52 and pivotable about the axis 50 by a conventional drive arrangement. When the detector 40 senses absence of a product in slot 38, it will activate the flag 46 to pivot in a counter clockwise direction as shown in FIG. 3. Product 26*a* is initially rotating on the shelf 24 in the storage area 36. This first product 26*a* will be engaged by flag 46 and held in position while the shelf 24 continues to rotate. Product 26*b* in FIG. 3 indicates a product in a product placement slot 38. FIG. 3 omits certain interior structure of the housing 12 in order to simplify the disclosure.

As previously discussed, the products 26*a* in the storage area are normally rotating with shelf 24. When the detector 40 senses absence of the product from slot 38, the shelf 24 continues to rotate. The empty slot 38 will move adjacent the loading area 42. The flag 46 will be pivoted counter clockwise to the position shown in FIG. 3. This flag 46 will engage one of the products 26*a* and prevent its further rotation. The shelf 24 continues to rotate despite the blockage of product 26*a*. When the empty product placement slot 38 is adjacent the loading area 42, the pusher 48 can be activated. The pusher 48 will pivot about axis 50 in a counter clockwise direction in order to move the product 26*a* to the empty product placement slot 38. Thus, the product will move from position 26*a* to position 26*b*. A conventional drive such as a solenoid, mechanical linkage or any other suitable arrangement can be used in order to power the pusher 48. This escapement mechanism 34 will automatically load products 26 into empty product placement slots 38. Therefore, a continuous display of products will be seen through the port 22.

In FIG. 2, the storage area 36 is shown as being filled with products 26. After a first product 26*a* is dispensed to an empty product placement slot 38', a gap will be provided in the line of products in the storage area 36. Upon subsequent release of products, additional gaps can be formed. When the flag 46 is pivoted to a closed position, the first product to engage this flag will stop rotating. Subsequently, other products will be pushed into engagement with the downstream products. This will act to close up some of the gaps as products are dispensed. While not shown, the storage area 36 can have an interior rail for keeping the products aligned. Centrifugal force also helps to keep the products towards the outer edge of the storage area 36 but an additional rail or guide could be used if so desired.

Eventually, upon removal of a sufficient number of products from the storage area 36, the panel 28 can be moved to the pocket 34 and the storage area can be restocked. During such a stocking operation, the products 26 in the port 22 may need to be moved in order to provide additional access to the storage area if necessary. Alternatively, the height of the product relative to the panel 28 might be such that it is unnecessary to remove the products in port 22. The new products can simply be loaded in over existing products.

After the product 26*a* is moved to the empty slot 38', the flag 46 and pusher 48 will move in a counter clockwise direction to be out of the way. This will enable continued rotation of the products on the shelf 24. Because the pusher 48 and flag 46 are mounted about axis 50 which is less than the height of the product 26 as shown in FIG. 3, it is contemplated that only a single row of products will be provided around the interior of the storage area 36. However, additional products could be loaded in the storage area 36 and then move to the outer periphery of the storage area through centrifugal force or by a pusher mechanism (not shown), if so desired. Also, the flag 46 and pusher 48 could be located at a certain height so that their structure would be in a non-interfering position for rotation of products filling the storage area 36 if so desired.

A wall 54 separates the storage area 36 from the portion of the shelf having the product placement slots 38. Both the storage area and the area of the housing having the product placement slots except at the port 22 form an interior portion 32 of the housing as noted above.

While FIG. 2 shows a single storage area 36 and shelf 24, it should be apparent from FIG. 1 that a plurality of shelves 24 and storage areas 36 are provided. Each of the plurality of shelves 24 have the associated structures such as the panel 28, escapement mechanism 44, detector 40, etc. If so desired, these structures and in particular, the control structures such as detector 40 and escapement mechanisms 44 can be coordinated between the different shelves or they can act independently of one another.

The plurality of shelves are driven by a drive 56. This drive 56 is connected to shaft 58 shown in FIGS. 2 and 3. The shaft 58 is centrally located within the interior of the housing 12 but variations in its positioning are possible. The shaft 58 passes vertically through the housing and is engaged with each of the shelves. Upon driving of the shaft 58 by the drive 56, the shelves 24 can be rotated in a clockwise or counter clockwise direction. While the drive 56 is shown as being in the base 14 of the housing 12, it should be appreciated that this drive can be placed in any suitable location, such as the top 18. Also, instead of being within the housing 12, the drive 56 could be located externally of the housing and operatively connected to the shaft 58 or other suitable drive arrangement.

Each of the shelves can have a slip clutch 59 as schematically shown in FIG. 2. Therefore, if an obstruction prevents rotation of one shelf 24, other shelves can continue to rotate and damage to the motor or drive 56 is prevented. Also, this clutch provides a safety mechanism for avoiding potential harm to consumers reaching into the interior of the housing through the port 22.

While FIG. 1 indicates a single motor or drive 56, it is contemplated that a plurality of motors could be used if so desired or that the motor can have suitable gearing for driving the shelves in different directions or at different speeds. Also, a gear arrangement at the periphery of the shelf could be used instead of central shaft 58. Many different drive arrangements are possible.

In addition, alternating shelves could move at different directions or at different speeds or any other suitable shelf rotation arrangement can be had. The shelves 24 can also move continuously or incrementally. Alternating shelves can move in opposite directions to increase the visual effect of movement without increasing the speed. The moving display of the cooler 10 of the present invention has three times as many product facings as similar size coolers with a fixed display.

There are many alternative embodiments for moving products that are contemplated. For example, conveyor chains instead of rotating shelves could move the products. There could also be more than one opening or port 22 to display the moving products. Moreover, the movement of products does not have to be continuous but can be incremental, for example. Also, the means to move the product from the storage area 36 to a product placement slot 38 can be done without an escapement mechanism 44. For example, gravity feed or another arrangement could be used.

Moreover, the shelves 24 could actually be divided between a fixed shelf in the storage area 36 and a moveable annular shelf having the product placement slots 38. Then scuffing of the product as discussed above would not be a problem because the portion of the shelf having the product placement slots 38 would continue to move whereas the portion of the shelf in the storage area 36 would be fixed. In such an arrangement, it is important to properly time filling of an empty slot 38' from the storage area.

While a plurality of shelves 24 are shown in the cooler 10 of FIG. 1, it should be appreciated that the concepts of the present invention can be used in a cooler having a single shelf, if so desired. Alternatively, two, three or four shelves (as shown) or more than four shelves could be used in the cooler 10.

In addition, as apparent from FIGS. 1 and 2, the housing 12 of the cooler has a generally cylindrical shape and the shelves are generally round. Alternative shapes for the cooler 10 can be provided. For example, an oval or square housing 12 could be used with a round shelf. The confines of the shelf may not match the confines of the interior of the housing in such an arrangement. Alternatively, when using a chain or other means for conveying, such a round, oval or other shaped housing 12 could be readily accommodated. Also, the products could be moved along an inclining or declining spiral path. Other possible arrangements can be had. It is, however, contemplated that the generally round cooler and shelf arrangement as shown have some advantages such as ease in manufacturing.

In FIG. 1, it should be readily apparent that a door or other closure is not provided at the port 22. This enables the consumer to easily reach into the port 22 and remove product 26. The consumer therefore need not use two hands, one to open the door and one to remove the product. The absence of doors also makes the products easier to see. Problems with conventional doors such as the glass becoming dirty, scratched, or masked with advertisements and therefore hiding the product are avoided with the present invention. Also, as previously noted, conventional doors have problems with fogging or condensation on the glass which could make it difficult to see the products. In the cooler 10 of the present invention, the products 26 are always readily visible. It should be noted that for clarity, the products 26 have been omitted in FIG. 1. When viewed through the port 22, the products in the slots 38 of shelves 24 would be readily visible. Bulky door frames which reduce the viewing area 72 are avoided with the present invention. Also, the present invention has the advantage that expensive insulated glass doors can be avoided.

While a door is absent during normal operation of the cooler 10, it is contemplated that when the cooler is in a standby or off mode, some cover or door structure could be provided over the opening of port 22. This will help maintain the cooling within the housing 12 as will be described below. However, such a cover or door need not necessarily be used.

The cooling in the housing 12 is accomplished by refrigeration device 60. This device 60 is schematically shown in the base 14 of the housing 12 in FIG. 1. A conventional modular refrigeration unit can be housed within the base 14. Alternatively, this refrigeration device 60 can be located within the body 16 or top 18 of the housing. Locating the refrigeration device 60 in the base 14 adds to overall stability of the housing 12, however. Also, instead of mounting the refrigeration device 60 within the housing 12, this device 60 can be located externally of the housing, if so desired.

The refrigeration device 60 will cool the interior portion 32 of the housing 12. The housing 12 as well as the panel 28 are thermally insulated. A separate cooling arrangement is not contemplated for the exposed portion 30 of the housing 12. The fact that the cooler has no doors makes the products 26 easier to see and retrieve as noted above but can lead to loss of cooling. With existing air curtain merchandisers, large open display areas are provided. Such conventional merchandisers, however, are extremely inefficient and tend to cool the area that surrounds them. The cooler 10 of the present invention solves this problem in part by using the insulated panel 28. This panel 28 backs-up the display area at port 22.

The storage area 36 is hidden behind the thermally insulated panel 28 when it is in the closed position. This makes for a more attractive display and helps to prevent loss of cooled air from the interior portion 32 of housing 12. This design dramatically reduces the amount of open area of the cooler 10 while at the same time putting a large amount of product 26 on display.

Additionally, the products 26 are moved single file through small openings or doors 62 in and out of the display area in the exposed portion 30 of the housing 12. Basically, these doors 62 are formed between the insulated panel 28 and the edges of the body 16 adjacent the port 22. Not only are the open areas or doors 62 smaller than conventional coolers, but they are usually blocked with products 26 at doors 62. This will further reduce the air flow through this door 62 in order to maintain cool air within the housing 12. The cool air moving inside the housing 12 does not apply a positive or negative pressure to the product openings at doors 62. Bottles, cans, or other products 26 are in the cool enclosed interior portion 32 in the rear of the cooler 10 for a majority of the time they are moving on the shelf 24 and while they are in storage area 36. Therefore, the cooler 10 of the present invention efficiently maintains cool products 26 while avoiding loss of chilled air to the surrounding environment. This cooler 10 solves problems which are inherent with conventional air-curtain displays.

While the width of the doors 62 are shown as closely matching the width of the products 26, the height of the doors 62 above the individual shelves 24 can also be matched to the height of the products. This will further reduce the amount of open area to the interior portion 32 of the cooler. As noted above, these openings or doors 62 would generally be blocked by the products moving therethrough thereby helping to reduce escape of cool air from the interior portion 32 of the housing 12.

While the height of the doors 62 have been discussed as matching the height of the products 26, such an arrangement is not necessary. Different types of products may be displayed on the different shelves. For example, beverage cans may be displayed on the uppermost shelf while beverage bottles are displayed on lower shelves. Because cans and bottles might have different heights, and to permit ready alteration of display locations, the heights of the doors 62 may be of a uniform size. Therefore, beverage cans or bottles or other products 26 could be readily switched between the different shelves 24.

Apart from holding products having different heights, products having different widths could also be displayed in the cooler 10 of the present invention. For example, one or two liter beverage bottles and then individual beverage cans or bottles can be displayed on different shelves in the cooler 10. The widths of door 62 could be varied between the different levels of shelves in order to accommodate these different product widths.

Alternatively, a standard width could be provided. In order to reduce the amount of open space around the doors 62 when using smaller products, flaps or brush-like bristles can be provided around the periphery of the doors 62. When larger products would move through the door, then the flaps or bristles would be pushed to an out of the way position in order to allow exiting and entrance of the products. However, for smaller products, the flaps or brush-like bristles would remain in position and therefor help block the space between the smaller size product and the door frame. This blockage would help to minimize cool air loss. Therefore, in such an arrangement, switching of different sized products between different shelves or placement of different sized products on the same shelf would be possible. In order to simplify construction, however, the door height and widths can simply be of a uniform construction without any further air blocking features if so desired.

The panel 28 is thermally insulated and will serve as a background for the displayed products in the port 22 as noted above. The panel 28 will also minimize the open area to the refrigerated compartment in the interior portion 32 of the housing 12. When moved to the open position in pocket 34, the panel 28 will allow first-in-first-out loading of warm products into the center of the cooler 10 at storage area 36. Therefore, products which have been in the cooler 10 for some time will normally be on the periphery of the shelf 24 in the various product placement slots 38. These will be the first products presented to the consumer during rotation of the shelf and therefore warm products would not normally be presented to a consumer.

The insulated panel 28 can have a small lip facing the product placement slots 38 on the shelves. This lip could be equipped with a rotation device 64. For example, this rotation device 64 could be a friction surface which will engage the products 26 and cause them to rotate about their vertical axes. Therefore, not only will the products rotate on shelf 24 about the axis through the central shaft 58, but they can also rotate about their own vertical axes. This will help to attract consumer's attention. If potential scuffing of the products or if non-round products are handled, then this rotation device 64 can be omitted. It should be noted that it is contemplated that the rotation device 64 is provided in the area of port 22 alone. Therefore, the products will only be spinning as they travel through the port 22. Of course, the rotation device 64 could be provided on the interior of the wall of the housing 12 adjacent the shelf as so desired such that the products continually spin if so desired. Each of the shelves 24 can be equipped with the rotation device 64 or alternating shelves or a single shelf or any other desired configuration of shelves can be equipped with this rotation device 64.

Figure 4:
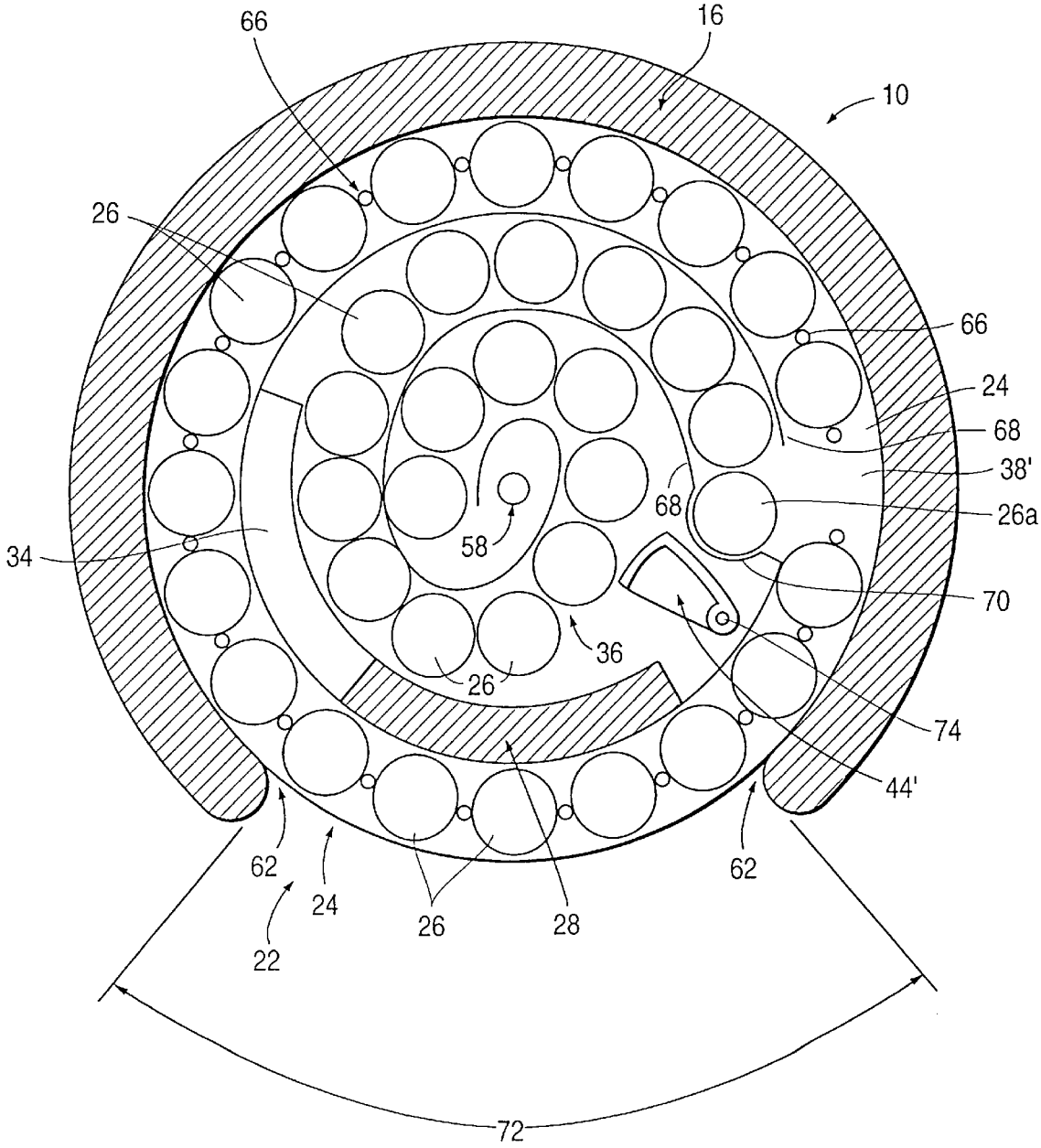
FIG. 4 is a cross sectional view similar to FIG. 2 showing a second embodiment of the cooler of the present invention.

Turning now to FIG. 4, a second embodiment of the cooler 10 will be described. In the storage area 36, a spiral wall 68 is provided. This spiral wall 68 initially encircles the driven shaft 58. The wall 68 spirals outwardly in order to form a path for products 26 in the storage area 36. The end of the path leads to a notched wall 70 adjacent escapement mechanism 44'. This escapement mechanism 44' includes a pusher which is pivotable about a vertical axis 74. When an empty product placement slot 38 is detected by detector 40, the pusher of escapement mechanism 44' will be activated. This pusher will rotate in a clockwise direction as seen in FIG. 4 about the vertical axis 74. This rotation will cause the product 26*a* to move into the empty slot 38'. Similarly to the first embodiment, this arrangement keeps the product placement slots 38 filled such that the products are always on view in the port 22.

The spiral path along which the products move in the storage area maximizes the amount of utilized space in the storage area 36. More products can be stored in the storage area 36 of the second embodiment. It is contemplated that a single one-piece shelf 24 will be used in the embodiment of FIG. 4. Therefore, when a product is caught in the notched wall 70, this product 26*a* as well as the other products in the storage area will be held in position while the shelf therebelow continues to move. The products in the product placement slots 38 will continue to rotate with the shelf. Those products in the storage area might be scuffed due to frictional contact with the rotating shelf. If such products are being handled, the embodiment shown in FIG. 2 may be more suitable. However, for products which are not sensitive to scuffing or in which there is a quick turnaround of products, this second embodiment is useful. Of course, an inner shelf and surrounding annular shelf arrangement could also be used in the second embodiment as has been discussed above with reference to the first embodiment.

When using a two-piece shelf the central shelf would underlie the storage area 36 while the outer annular shelf would surround the storage area and have the product placement slots 38. Separate drives could be provided to continuously drive this outer annular shelf and incrementally drive the inner shelf when loading of products into an empty slot 38' occurs. Alternatively, a slip clutch arrangement could be provided such that the two shelves are driven by the same motor but the inner shelf at the storage area would be held in position until discharge of product 26*a* to an empty slot 38'. Other arrangements for the shelf and drive are possible.

Similarly to the first embodiment, the second embodiment of FIG. 4 has a moveable panel 28 which will move into the pocket 34 in order to enable loading of the products into the storage area. The spiral wall 68 has a height sufficiently low to accommodate loading of products into the storage area 36.

The present invention provides for a doorless merchandising cooler 10 which enables one handed withdrawal of products 26. A door or other closures are avoided therefore simplifying the cooler construction. Products are continuously visible and will not be hidden by a scratched, dirty door or a door masked with advertisements. Also, the products will not be hidden by fogging or condensation on a glass door and the viewing area 72 can be maximized. A bulky doorframe will not reduce the overall viewing area.

The present invention will also provide for a first-in-first-out loading system such that warm products will normally not be presented to a consumer. The rotating shelves will attract a consumer's attention. In addition, the individual products can be made to rotate around their own axes to further draw attention to the merchandising cooler 10. Also, the individual shelves 24 can be made to rotate at different speeds or directions or to continuously or incrementally rotate. This can further make the cooler 10 stand out so that it will not blend in with its surroundings. By provision of the guides 66 for the product placement slots 38, the products 26 will be maintained in a neat, orderly arrangement. The products in the storage area 36 are also hidden by the insulated panel 28 thereby presenting the products in a orderly fashion. If so desired, however, the panel 28 could be made transparent so that the interior of the cooler 10 could be visible to further attract a consumer's interest. However, only the products on the outermost periphery of the shelves in the product placement slots 38 would be accessible by the consumer so that they would not have the tendency to reach over products thereby disorienting the outermost products on the shelf.

The present invention also provides for an efficient cooling arrangement which avoids cooling of the surrounding environment. The amount of open area of the cooler 10 is dramatically reduced while at the same time, a large amount of products are on display. The insulating panel 28 can also have graphics or other advertisement material thereon to further enhance the display if so desired.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A cooler comprising:

a housing with a discharge port, the housing having an interior portion and an exposed portion, the exposed portion being adjacent the discharge port, the exposed portion of the housing being open to ambient environment through the port for unobstructed access to the exposed portion of the housing;

a movable shelf;

a drive for moving the shelf between the interior portion of the housing and the exposed portion of the housing;

a refrigeration device for cooling at least the interior portion of the housing;

a storage area within the interior portion of the housing;

an escapement mechanism for loading products on the shelf from the storage area; and a panel separating the interior portion of the housing from the exposed portion thereof, the panel being movable between an open position and a closed position.

2. The cooler as recited in claim 1, wherein the storage area is accessible through the discharge port and the exposed portion when the panel is in the open position, and access to the storage area from the exposed portion is blocked when the panel is in the closed position.

3. The cooler as recited in claim 1, wherein the panel forms at least one door through which the shelf is moved, the panel reducing exposure of the interior portion of the housing to ambient environment whereby such exposure to ambient environment during operation of the cooler is through the at least one door.

4. The cooler as recited in claim 1, wherein the panel is insulated.

5. The cooler as recited in claim 1, wherein the panel is horizontally slidable between the open position and the closed position.

6. The cooler as recited in claim 1, further comprising a plurality of shelves which includes the movable shelf, each of the shelves being movable by the drive, a plurality of the panels being provided between the interior portion and the exposed portion of the housing adjacent each of the shelves, and a plurality of the storage areas being provided in the interior portion of the housing for each of the shelves.

7. The cooler as recited in claim 6, wherein the drive includes a shaft within the housing, the shaft passing through each of the shelves and the shelves being vertically arranged one over the other.

8. The cooler as recited in claim 1, wherein the housing is generally cylindrical and wherein the shelf is generally round.

9. The cooler as recited in claim 1, wherein the shelf is positioned in both the interior and exposed portions of the housing as well as in the storage area, an edge of the shelf having a plurality of product placement slots for receiving products from the storage area, the product placement slots being movable from the interior portion to the exposed portion of the housing.

10. The cooler as recited in claim 9, wherein the shelf is round and wherein the product placement slots are located around a periphery of the shelf, the storage area being centrally located on the shelf.

11. The cooler as recited in claim 9, further comprising a detector for determining when a product placement slot on the shelf is empty and for activating the escapement mechanism to move a product from the storage area to the periphery of the shelf.

12. The cooler as recited in claim 11, wherein products in the storage area rest on the shelf and are movable therewith except when the escapement mechanism is loading a product into an empty product placement slot.

13. The cooler as recited in claim 12, wherein the escapement mechanism includes a flag and a pusher, the flag temporarily blocks movement of products in the storage area when activated and the pusher moves products from the storage area to an empty product placement slot.

14. The cooler as recited in claim 11, further comprising a spiral wall provided in the storage area for aligning products in the storage area with the escapement mechanism.

15. The cooler as recited in claim 11, further comprising a panel separating the interior portion of the housing from the exposed portion thereof, the panel being movable between an open position and a closed position, the panel separating the storage area from the exposed portion in the closed position and providing access to the storage area when in the open position.

16. The cooler as recited in claim 1, further comprising a rotation device for rotating products on the shelf as the shelf moves through the exposed portion of the housing such that individual products are rotatable about their vertical axes as the shelf moves from the interior portion to the exposed portion of the housing.

17. The cooler as recited in claim 1, further comprising guides forming product placement slots on the shelf, the guides aligning products on a periphery of the shelf.

18. The cooler as recited in claim 17, wherein a single depth of products are exposed on the shelf in the exposed portion of the housing and wherein a plurality of placement slots are provided on the shelf in the exposed portion of the housing.

19. The cooler as recited in claim 1, further comprising a plurality of shelves which includes the movable shelf, each of the shelves being movable by the drive and at least one of the shelves being movable at a different speed or direction than another one of the shelves.

20. A cooler comprising:

a housing with a discharge port, the housing having an interior portion and an exposed portion, the exposed portion being adjacent the discharge port, the exposed portion of the housing being open to ambient environment through the port for unobstructed access to the exposed portion of the housing;

a rotatable shelf;

a drive that rotates the shelf between the interior portion of the housing and the exposed portion of the housing;

a refrigeration device that cools at least the interior portion of the housing;

a storage area within the interior portion of the housing; and an escapement mechanism that loads products on the shelf from the storage area.

21. A cooler comprising:

a housing with a discharge port, the housing having an interior portion and an exposed portion, the exposed portion being adjacent the discharge port, the exposed portion of the housing being open to ambient environment through the port for unobstructed access to the exposed portion of the housing;

a plurality of movable shelves;

a drive that moves the shelves between the interior portion of the housing and the exposed portion of the housing, the drive including a shaft within the housing, the shaft passing through each of the shelves;

a refrigeration device that cools at least the interior portion of the housing;

a storage area within the interior portion of the housing; and an escapement mechanism that loads products on the shelf from the storage area.

22. The cooler as recited in claim 21, wherein the shelves are vertically arranged one over the other.

* * * * *